US008584851B2

(12) United States Patent
Brendel

(10) Patent No.: US 8,584,851 B2
(45) Date of Patent: Nov. 19, 2013

(54) TRANSPORT HOUSING FOR A COIL OR A COIL BLOCK

(75) Inventor: Hartmut Brendel, Halle (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/569,877

(22) Filed: Aug. 8, 2012

(65) Prior Publication Data

US 2013/0037442 A1 Feb. 14, 2013

Related U.S. Application Data

(63) Continuation of application No. PCT/EP2011/050610, filed on Jan. 18, 2011.

(30) Foreign Application Priority Data

Feb. 8, 2010 (EP) ..... 10001256

(51) Int. Cl.

| | |
|---|---|
| ***B65D 85/00*** | (2006.01) |
| ***B65D 85/66*** | (2006.01) |
| ***B65D 19/00*** | (2006.01) |
| ***B65H 18/28*** | (2006.01) |

(52) U.S. Cl.

USPC ..... 206/408; 206/410; 206/597; 242/129; 242/160.3; 242/170

(58) Field of Classification Search

USPC ..... 206/386, 389, 391–394, 397, 408, 413, 206/597, 600; 242/129, 159, 171, 160.3, 242/170

See application file for complete search history.

(56) References Cited

U.S. PATENT DOCUMENTS

| | | | | |
|---|---|---|---|---|
| 1,618,542 | A * | 2/1927 | Ludwig | 206/452 |
| 3,337,044 | A * | 8/1967 | Smith et al. | 206/413 |
| 3,491,876 | A * | 1/1970 | Zecchin | 206/408 |
| 5,105,943 | A * | 4/1992 | Lesko et al. | 206/397 |
| 5,819,934 | A * | 10/1998 | Cooper | 206/397 |
| 6,386,364 | B2 * | 5/2002 | Kawasaki et al. | 206/408 |
| 6,502,700 | B2 * | 1/2003 | Goostree | 206/597 |
| 6,857,521 | B2 * | 2/2005 | Cantu-Gonzalez | 206/397 |

(Continued)

FOREIGN PATENT DOCUMENTS

| | | |
|---|---|---|
| CH | 355 516 A | 7/1961 |
| EP | 0 648 684 A1 | 4/1995 |

OTHER PUBLICATIONS

International Search Report (PCT/ISA/210) issued on Mar. 4, 2011, by the European Patent Office as the International Searching Authority for International Application No. PCT/EP2011/050610.

*Primary Examiner* — Bryon Gehman

(74) *Attorney, Agent, or Firm* — Buchanan Ingersoll & Rooney PC

(57) ABSTRACT

A transport housing for a coil or a coil block, having an upper and a lower pressing plate, wherein the coil or the coil block is arranged between the two pressing plates and the latter can be braced against each other by a plurality of tension rods in the manner of an axial tension configuration. A frame enclosing the coil or the coil block to which a membrane, movable both toward the inner chamber of the transport housing and toward the outside, is fastened and having an outer housing which provides mechanical protection for the membrane and enables unhindered or allows movement of the membrane to the outside.

17 Claims, 3 Drawing Sheets

(56) References Cited

U.S. PATENT DOCUMENTS 7,152,735 B2 * 12/2006 Dragoo et al. ..... 206/408
7,172,070 B2 * 2/2007 Coon et al. ..... 206/397
2008/0236102 A1 * 10/2008 Murakami et al. ..... 206/408

* cited by examiner

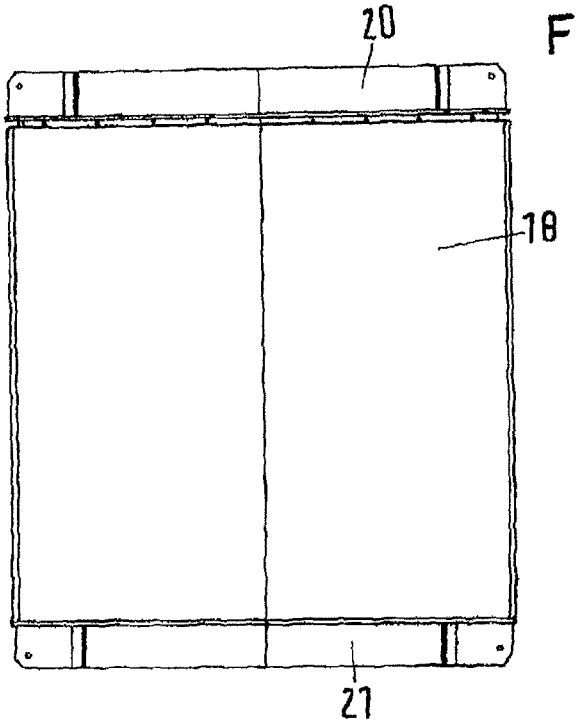
Fig.3
Fig.4
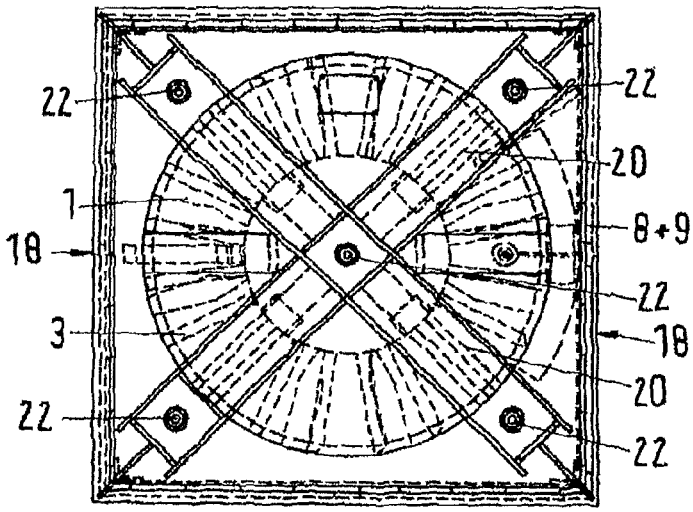

TRANSPORT HOUSING FOR A COIL OR A COIL BLOCK

RELATED APPLICATION(S)

This application claims priority as a continuation application under 35 U.S.C. §120 to PCT/EP2011/050610, which was filed as an International Application on Jan. 18, 2011 designating the U.S., and which claims priority to European Application 10001256.6 filed in Europe on Feb. 8, 2010. The entire contents of these applications are hereby incorporated by reference in their entireties.

FIELD

The disclosure relates to a housing for a coil or a coil block.

BACKGROUND INFORMATION

As result of the increasing number of on-site repairs to transformers, bottlenecks in coil manufacture in individual manufacturing locations of a transformer plant, and the simultaneously free winding capacity at other locations, the transportation of coils for oil-filled transformers less than 1000 kVA and pre-assembled coil blocks without the associated transformer tank and without associated cores is acquiring greater importance.

Coils for oil-filled transformers are generally transported (A) completely dry, (B) vertically and axially clamped with a defined force, (C) radially supported, and (D) complying with specified width and height dimensions.

The specification according to (A) results from on-site repairs, where technical equipment for drying the coils is not usually available and the technical equipment cannot be provided at a reasonable expense. When coils are transferred between different manufacturing locations without dry transportation, the coils are first dried before installation, which often results in time and capacity problems.

The specification according to (B) results from the fact that coils have to be fitted in a short-circuit-proof manner, axially clamped under a defined force and thereby set up under pressure to a defined installation length. However, the technical prerequisites for pressing coils and coil blocks are not usually available on site. For example, when coils are transferred between different manufacturing locations, the same time and capacity problems can occur as with drying. In addition it is not technically possible to transport coils without any axial clamping.

The specification for radial support when transporting coils according to (C) results from the fact that coils and coil blocks mounted on the active part are supported by the solid core legs. Their construction with correspondingly thin supporting cylinders is not designed for unsupported transportation. Thus, it is not possible to transport coils without radial fixing or support.

The specification according to (D) result from width dimensions which, in the case of land transport, arise from the width of the roadways to be used and the building regulations for trucks derived therefrom, and from height dimensions which are derived from necessary bridge clearances and similar. The same also applies to rail transport. In the case of sea transport, in addition to the above-mentioned specifications, container dimensions and the specifications relating to stackability are also taken into account.

According to known transport housings, when transporting coils or coil blocks, the specifications according to (B) and (C) are usually implemented by fitting the coils or coil blocks into a press frame consisting of lower and upper pressing plate and tie rods for fixing under pressure.

According to known transport housings, the specifications according to (A) is usually fulfilled by transporting the coils in pressure-tight transport tanks, which are specially designed for this means of transport and are therefore expensive. Thus, the use of a transport tank can be restricted to one or sometimes a few means of transport. For example, the press frame with the coils is placed and fixed in this transport tank and then screwed pressure-tight by means of a cover. In order to provide protection against moisture during transportation, this configuration is then either filled with dry air, and a positive pressure is maintained in the tank by means of an attached system with a pressure cylinder for the entirety of the transportation period. Alternatively, the transport tank can be filled with dried transformer oil and an oil-free space between the top of the coil and the bottom of the tank is connected to the external atmosphere via an air dryer, which is used to balance the temperature. At the same time, the external dimensions of the transport are a consideration.

The previous implementation of the processes according to (A) for dry transportation by means of transport tanks due to their construction and their manufacture, uses pressure-tight transport tanks, which are very expensive, i.e. the price of a transport tank is up to 40% of the cost of the leg coils to be transported.

When transporting with dry air, the maintenance of the positive pressure is monitored at regular intervals during transportation.

The additional dimensions for transport tank, cover, compressed air system or dry air storage for oil transportation with air cushions reduce the space remaining for the coil block itself in the given transport volume.

Above a certain coil size, cost-intensive special transport means, including night travel, single lane closures, police escort etc., may be used depending on the dimensions of the pressed coil block.

In the case of on-site repairs, the associated additional costs have been be taken into account and up to now, the high transport costs have prevented coils being transferred between different manufacturing locations to make use of free winding capacity for want of appropriate cost effectiveness.

SUMMARY

A transport housing for a coil or a coil block as disclosed, comprises: an upper and a lower pressing plate, configured for arrangement and clamping of a coil or coil block between the upper and lower pressing plates, against the upper and lower pressing plates by a plurality of tie rods in an axial clamping configuration; a frame for enclosing the coil or the coil block and having a membrane, which is movable both towards an interior of the transport housing and towards an outside of the housing; and an outer housing, which provides mechanical protection for the membrane and allows movement of the membrane.

A transport housing for a coil or a coil block as disclosed, comprises: an upper and a lower pressing plate, configured for arrangement and clamping of a coil or coil block between the upper and lower pressing plates, clamped against the upper and lower pressing plates by a plurality of tie rods in an axial clamping configuration; a frame enclosing the coil or the coil block having a membrane, which is movable both towards an interior of the transport housing and towards an outside of the housing, and wherein the frame includes an outer frame and an inner frame, and the membrane is clamped between the outer frame and the inner frame; an outer housing, which provides mechanical protection for the membrane and allows movement of the membrane; and wherein the coil or coil block is located in the housing in contact with the axial clamping configuration via an upper and a lower block support.

BRIEF DESCRIPTION OF THE DRAWINGS

The disclosure is explained below with reference to the exemplary embodiments shown in the drawing. In the drawings:

FIG. 3 shows a side view of a transport housing;

FIG. 4 shows a view on a transport housing with the housing cover removed;

DETAILED DESCRIPTION

The disclosure is based on providing a cost-effective transport housing for a coil or a coil block which fulfils the above-mentioned specifications.

According to the disclosure, a transport housing for a coil or a coil block includes an upper and lower pressing plate, wherein the coil or the coil block is arranged between the two pressing plates and the coil or coil block can be clamped against the upper and lower pressing plates with a plurality of tie rods in the manner of an axial clamping configuration. The axial clamping configuration having a frame, which encloses the coil or the coil block to which a membrane, movable both towards the interior of the transport housing and towards the outside, is fixed, and an outer housing which, provides mechanical protection for the membrane and, enables unhindered or allows movement of the membrane to the outside.

According to an exemplary embodiment, the coils or pre-assembled coil blocks withstand the loads of transportation, e.g. non-containerized sea transport in the form of individually packaged goods, without damage and without absorbing moisture. In comparison with the known transport housing, this can result in a considerable reduction in transport costs. In addition, the structural components of the transport housing can be reused many times after completion of transportation of the coil or the coil block and dismantling.

Figure 1:
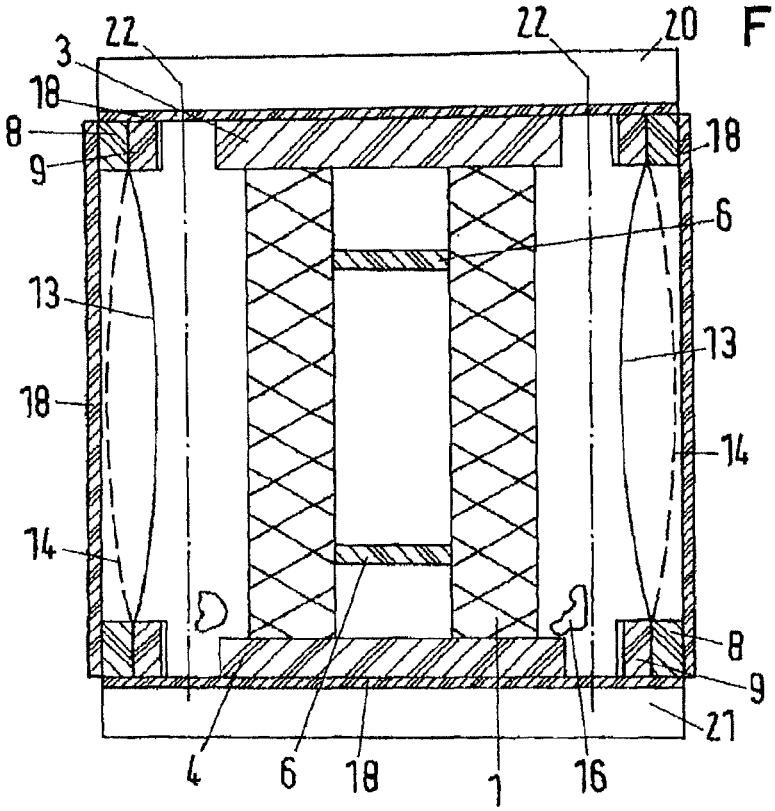
FIG. 1 shows a lateral section through a transport housing, wherein the functional principle of a membrane used in the transport housing is additionally outlined.

A lateral section through a transport housing is shown in FIG. 1, wherein the functional principle of a membrane used in the transport housing is additionally outlined. As shown in FIG. 1, a coil 1, the upper face of which makes contact with a, for example wooden, upper block support 3 and the lower face of which makes contact with a likewise, for example wooden, lower block support 4. A plurality of, for example wooden, radial supports 6 serves to support the hollow cylindrical shaped interior of the coil 1. The transport housing has a supporting frame 8, 9, which is for example made of wood and is formed from an outer frame 8 and an inner frame 9 forming a cuboid.

The frame 8, 9 can also be used to secure an outer housing 18, for example made of wood, consisting of floor, cover and four side walls (e.g., plywood sheeting). At the same time, the upper block support 3 makes contact with the cover of the outer housing 18, and the lower block support 4 makes contact with the floor of the outer housing 18. For the axial clamping of the coil 1, an upper pressing plate 20 (pressing cover) is arranged on the outer surface of the cover and a lower pressing plate 21 (pressing floor) is arranged on the outer surface of the floor. These pressing plates 20, 21, which are at least partially made of metal, have a plurality of holes for the penetration of a plurality of tie rods 22 which run in a symmetrical manner in the interior of the transport housing. At the end, on at least one side, the tie rods 22 are provided with threaded holes so that the transport housing with the coil 1 inserted can be clamped between the upper pressing plate 20 and the lower pressing plate 21 using nuts placed on the tie rods 22 (fixing under pressure, axial clamping configuration).

A structural component of the transport housing is a membrane 13, 14 which is for example made of a plastic film, such as polyethylene, and which by way of example includes (e.g., consists of) a total of four membrane sections (film sections) which are each clamped between outer frame 8 and inner frame 9 parallel to the side walls of the outer housing 18. Designated membrane 13, the membrane position which occurs in the case of positive external pressure (in comparison with the pressure prevailing in the interior of the transport housing), and membrane 14 the membrane position which occurs in the case of negative external pressure (in comparison with the pressure prevailing in the interior of the transport housing).

A desiccant 16, for example in the form of a silica gel bag, is provided in the interior of the transport housing to absorb the residual moisture in the air in the interior of the transport housing.

Figure 2:
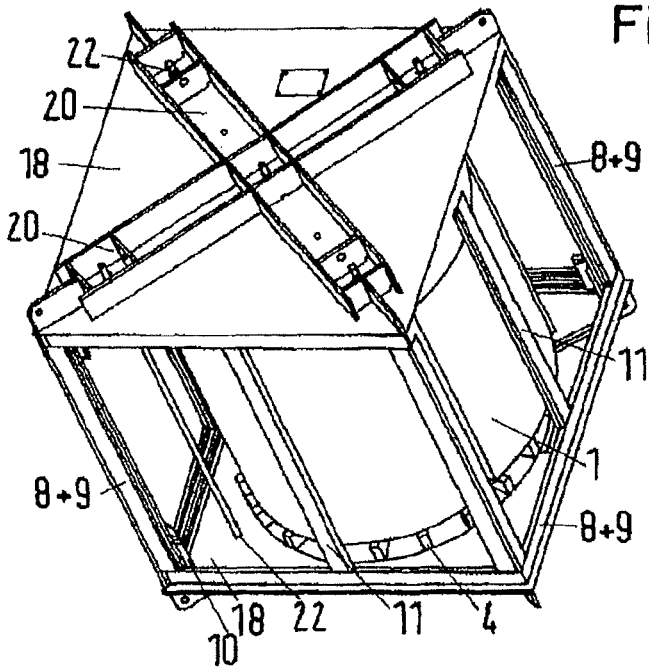
FIG. 2 shows a perspective view on a transport housing.

A perspective view on a transport housing is shown in FIG. 2. The cuboid-shaped structure and the frame construction of the transport housing which encloses the cylindrical coil 1 is shown. For clarity, all four side walls of the outer housing 18 have been removed and only the cover and floor of the outer housing 18 are shown. The upper pressing plate 20 is in the form of a cross formed from two beams, and the ends of each of a total of five tie rods 22, which are fixed to the upper pressing plate, are also shown. The lower block support 4 and the frame 8, 9 consisting of the outer frame 8 and the inner frame 9, and wherein, in the case of the four side walls of the outer housing 18, for example wooden intermediate frame 11 is additionally arranged centrally between the outer edges in each case to thus achieve an additional stiffening in the case of relatively large side walls and to achieve an additional central fixing facility when each side wall is formed from two side wall halves (two-part construction of the side walls).

Additional, for example wooden, stiffening sections 10 are provided in the corner regions of the frame 8, 9 to achieve an overall stiffening of the cuboid-shaped frame structure.

A side view of a transport housing is shown in FIG. 3. As shown in FIG. 3, the transport housing includes an upper pressing plate 20, a lower pressing plate 21 and a side wall of the outer housing 18. The side wall shown as shown is made up of two side wall halves.

A view on a transport housing with the housing cover removed is shown in FIG. 4. As shown in FIG. 4, the cross-shaped upper pressing plate 20 and the positions of the total of five tie rods 22 anchored therein. One tie rod 22 is arranged centrally, with the further four tie rods 22 arranged close to the four corners of the transport housing formed by the supporting frame 8, 9 and the outer housing 18. The position of the upper block support 3 in relation to the coil 1 and to the side walls of the transport housing is shown in dashed lines.

Figure 5:
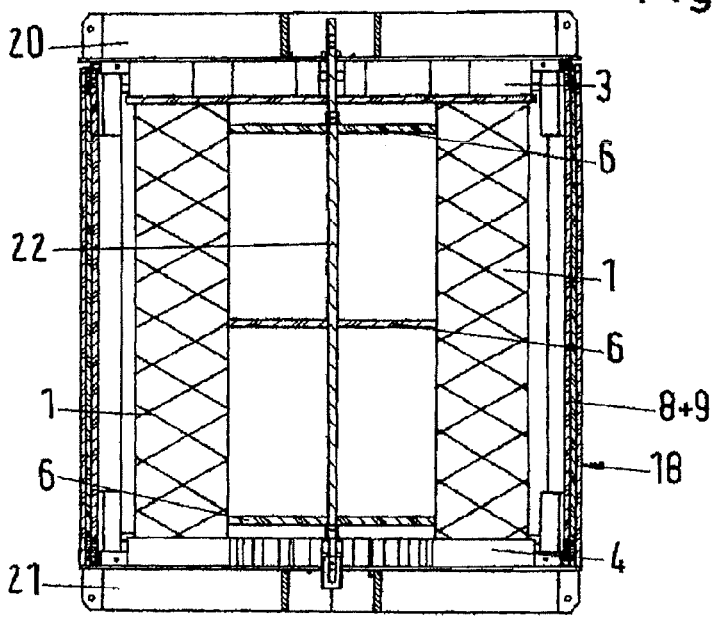
FIG. 5 shows a lateral section through a transport housing.

A lateral section through a transport housing is shown in FIG. 5, which shows the axial clamping of the coil 1 between upper pressing plate 20 with upper block support 3 and lower pressing plate 21 with lower block support 4 using the tie rods 22. Further, the radial support 6, which by way of example is formed from three separate structural components and the supporting frame 8, 9 with a protective outer housing 18.

Figure 6:
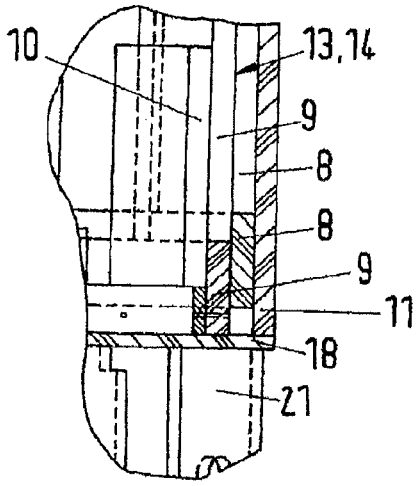
FIG. 6 shows a detailed view relating to the housing structure.

A detailed view relating to the housing structure is shown in FIG. 6, which shows the structure in the edge region of the transport housing with outer frame 8, inner frame 9, edge stiffening section 10, intermediate frame 11, floor of the outer housing 18 and lower pressing plate 21. The membrane 13, 14 is fixed between outer frame 8 and inner frame 9. Here, the edges of outer frame 8 and inner frame 9 are covered with an elastic structural component, for example an L-section made of rubber (rubber strip) in order to achieve a seal between the interior of the transport housing and the outer atmosphere, and also prevent sharp edges loading or acting upon the membrane 13, 14.

It can already be seen from the above explanation of the transport housing according to the disclosure that a tankless concept based on different physical principles compared with the known transport housing can be implemented to prevent the coil 1 from absorbing moisture during transportation.

For example, the coil 1 can be kept dry when being transported in the air-filled transport housing in that it is transported in an atmosphere consisting of dry air. A positive pressure is not necessary to maintain such a dry-air atmosphere or internal air which encompasses the coil. For example, the pressure in the space surrounding the coil or in the interior can be matched to the pressure outside without an exchange of air taking place between the dry internal air and the external air or the possibly moist external air. When this balance has been established, no further exchange of air takes place, and the dry air remains inside and the moist air remains outside.

This applies physically for the macroscopic range and can be maintained over a limited period until molecular mixing processes begin. For example, this limited period may be of the order of magnitude of six to eight weeks and that in practice an exchange of air does not take place in this period when the pressure balance or the equality of the internal/external pressure is guaranteed, even when there are small gaps between the interior of the transport housing and the external atmosphere. Here, the pressure balance is achieved with comparatively simple means by the membrane principle using the membrane 13, 14.

The outer frame 8 not only serves to clamp the membrane, but also as a spacer relative to the outer housing 18, which constitutes a protective layer to prevent mechanical damage to the membrane 13, 14 and creates the space necessary for the possible expansion of the membrane 13, 14 when the pressure in the interior of the transport housing increases, for example due to higher internal temperature compared with the external temperature. The pressure is balanced due to the expansion or bulging out of the membrane 13, 14 with the resulting increase in the internal volume. When the external temperature is higher in comparison with the internal temperature, the process acts in the opposite direction; the membrane 13, 14 bulges inwards and reduces the internal volume for the necessary pressure balance.

At the same time, the external free space between membrane 13, 14 and outer housing 18 effects the thermal insulation, which reduces the effects of internal and external temperature differences and slows down the pressure balancing processes. For example, for sea transportation and for extreme climatic conditions, which may occur during transportation, the outer housing 18 for example sealed with acrylic and subsequently coated with paint and thereby made weatherproof.

The above description refers to the coil 1, the coil 1 can also be a coil block.

With regard to clamping the pressing plate structure, a variant with five tie rods (including central rod) has been considered in the exemplary embodiment explained above. As an example, clamping forces up to approximately 600 kN may occur with this variant. As an alternative, a simpler variant with only four tie rods (central rod omitted) can also be implemented, wherein clamping forces up to approximately 400 kN can occur with such an embodiment. Variants with up to sixteen tie rods (and more) can be realized for large coil blocks where high clamping forces up to 2000 kN (and more) are required. With all embodiments, radial clamping is for example carried out in each case by means of steel cylinders welded to the pressing plates.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCES

1 Coil or coil block
3 Upper block support (wood)
4 Lower block support (wood)
6 Radial support (wood)
8 Outer frame (wood) of the frame 8, 9
9 Inner frame (wood) of the frame 8, 9
10 Stiffening section (wood)
11 Intermediate frame (wood)
13 Membrane position of the membrane 13, 14 (polyethylene) for positive external pressure
14 Membrane position of the membrane 13, 14 for negative external pressure
16 Desiccant (silica gel bag)
18 Outer housing with floor, cover, side walls (wood) of the transport housing for a coil or a coil block
20 Upper pressing plate (made at least partially of metal)
21 Lower pressing plate (made at least partially of metal)
22 Tie rods (metal)

What is claimed is:

1. A transport housing for a coil or a coil block, comprising:

an upper pressing plate and a lower pressing plate, configured for arrangement of a coil or coil block between the upper and lower pressing plates, and wherein the coil or coil block is clamped against the upper and lower pressing plates by a plurality of tie rods in an axial clamping configuration;

a frame for enclosing the coil or the coil block and having a membrane, wherein the membrane is movable both towards an interior of the transport housing and towards an outside of the housing, wherein the frame includes an outer frame and an inner frame, and the membrane is clamped between the outer frame and the inner frame; and an outer housing, which provides mechanical protection for the membrane and allows movement of the membrane.

2. The transport housing of claim 1, wherein edges of the outer frame and the inner frame are covered with an elastic structural component.

3. The transport housing of claim 2, wherein the elastic structural component, which covers the edges of the outer frame and the inner frame, is made of rubber and has an L-section cross section.

4. The transport housing of claim 1, wherein the outer housing is fixed to the frame.

5. The transport housing of claim 1, in combination with a coil or coil block in contact with the axial clamping configuration via an upper block support and a lower block support.

6. The transport housing of claim 5, comprising:

a radial support in an interior of the coil or the coil block.

7. The transport housing of claim 1, comprising:

a desiccant in an interior of the transport housing.

8. The transport housing of claim 7, wherein the desiccant is a silica gel bag, which is provided in the interior of the transport housing to absorb residual moisture in air in an interior of the transport housing.

9. The transport housing of claim 1, comprising:

a coil or coil block housed within the transport housing.

10. A transport housing for a coil or a coil block, comprising:

an upper pressing plate and a lower pressing plate, configured for arrangement of a coil or coil block between the upper and lower pressing plates, and wherein the coil or coil block is clamped against the upper and lower pressing plates by a plurality of tie rods in an axial clamping configuration;

a frame for enclosing the coil or the coil block and having a membrane, wherein the membrane is movable both towards an interior of the transport housing and towards an outside of the housing, wherein the frame includes an outer frame and an inner frame, and the membrane is fixed between the outer frame and the inner frame; and an outer housing, which provides mechanical protection for the membrane and allows movement of the membrane.

11. A transport housing for a coil or a coil block, comprising:

an upper pressing plate and a lower pressing plate, configured for arrangement of a coil or coil block between the upper and lower pressing plates, and wherein the coil or coil block is clamped against the upper and lower pressing plates by a plurality of tie rods in an axial clamping configuration;

a frame for enclosing the coil or the coil block and having a membrane, wherein the membrane is movable both towards an interior of the transport housing and towards an outside of the housing, and wherein the frame includes an outer frame and an inner frame, and the membrane is clamped between the outer frame and the inner frame;

an outer housing, which provides mechanical protection for the membrane and allows movement of the membrane; and wherein the coil or coil block is in contact with the axial clamping configuration via an upper block support and a lower block support.

12. The transport housing of claim 11, wherein edges of the outer frame and the inner frame are covered with an elastic structural component.

13. The transport housing of claim 12, wherein the elastic structural component, which covers the edges of the outer frame and the inner frame, is made of rubber and has an L-section cross section.

14. The transport housing of claim 11, wherein the outer housing is fixed to the frame.

15. The transport housing of claim 11, comprising:

a radial support in an interior of the coil or the coil block.

16. The transport housing of claim 11, comprising:

a desiccant in an interior of the transport housing.

17. The transport housing of claim 16, wherein the desiccant is a silica gel bag, which is provided in the interior of the transport housing to absorb the residual moisture in the air in the interior of the transport housing.

* * * * *